US008215860B2

(12) United States Patent
Uehara et al.

(10) Patent No.: US 8,215,860 B2
(45) Date of Patent: Jul. 10, 2012

(54) COSMETIC STORAGE TYPE APPLICATOR

(75) Inventors: Junya Uehara, Fujioka (JP); Nobuyuki Nakajima, Fujioka (JP); Masaaki Morita, Fujioka (JP)

(73) Assignee: Mitsubishi Pencil Co., Ltd., Shinagawa-ku, Tokyo (JP)

( * ) Notice: Subject to any disclaimer, the term of this patent is extended or adjusted under 35 U.S.C. 154(b) by 980 days.

(21) Appl. No.: 11/992,940

(22) PCT Filed: Oct. 11, 2006

(86) PCT No.: PCT/JP2006/320258

§ 371 (c)(1),
(2), (4) Date: Apr. 1, 2008

(87) PCT Pub. No.: WO2007/043555

PCT Pub. Date: Apr. 19, 2007

(65) Prior Publication Data

US 2009/0116895 A1 May 7, 2009

(30) Foreign Application Priority Data

Oct. 12, 2005 (JP) ..... 2005-297418
Oct. 13, 2005 (JP) ..... 2005-298838

(51) Int. Cl.
*B43K 5/00* (2006.01)

(52) U.S. Cl. ..... 401/202; 401/243; 401/245

(58) Field of Classification Search ..... 401/198, 401/202, 223, 241, 243, 245, 269, 213
See application file for complete search history.

(56) References Cited

U.S. PATENT DOCUMENTS

| | | | | |
|---|---|---|---|---|
| 3,466,132 | A | 9/1969 | Riepe | |
| 5,551,789 | A | 9/1996 | Okawa et al. | |
| 6,056,470 | A | 5/2000 | Nehashi et al. | |
| 6,428,235 | B1 * | 8/2002 | Takanashi et al. | 401/202 |

FOREIGN PATENT DOCUMENTS

| | | | |
|---|---|---|---|
| GB | 1386953 | | 3/1975 |
| GB | 2241881 | A | 9/1991 |
| JP | 48-026863 | | 8/1973 |
| JP | 48-26863 | A | 8/1973 |
| JP | 50-1200 | U | 1/1975 |
| JP | 59-5113 | U | 1/1984 |
| JP | 61-2814 | U | 1/1986 |
| JP | 61-67615 | U | 5/1986 |

(Continued)

OTHER PUBLICATIONS

European Communication dated Jun. 8, 2011 issued in the corresponding European Patent Application No. 06811565.8-1258.

(Continued)

*Primary Examiner* — Tuan N Nguyen
(74) *Attorney, Agent, or Firm* — Buchanan Ingersoll & Rooney PC

(57) ABSTRACT

In the cosmetic storage type applicator having a structure for supplying a cosmetic to an applying part from the interior of a barrel cylinder, a cap removably attached to the front part of the barrel cylinder for covering the applying part and plastic mouthpiece is provided; an inner sleeve having a tapered inside diameter toward the front end is arranged inside the body of cap and integrally formed with the cap body; and the inner peripheral surfaces and from the inner sleeve to the cap body are formed with a smooth surface without any step.

11 Claims, 11 Drawing Sheets

FOREIGN PATENT DOCUMENTS

| | | | |
|---|---|---|---|
| JP | 63-139810 | U | 9/1988 |
| JP | 2-111303 | A | 4/1990 |
| JP | 3-47112 | A | 2/1991 |
| JP | 05-16381 | U | 3/1993 |
| JP | 6-155980 | A | 6/1994 |
| JP | 06-66514 | U | 9/1994 |
| JP | 07-33685 | U | 6/1995 |
| JP | 07-228089 | A | 8/1995 |
| JP | 07-304292 | A | 11/1995 |
| JP | 9-322819 | A | 12/1997 |
| JP | 10-416 | A | 1/1998 |
| JP | 10-157381 | A | 6/1998 |
| JP | 11-129682 | A | 5/1999 |
| JP | 2000-25385 | A | 1/2000 |
| JP | 2001-113877 | A | 4/2001 |
| JP | 2001-121877 | A | 5/2001 |
| JP | 2001-252131 | A | 9/2001 |
| JP | 2002-36781 | A | 2/2002 |
| JP | 2002-241233 | A | 8/2002 |

OTHER PUBLICATIONS

International Search Report (PCT/ISA/210), Jan. 16, 2007.

* cited by examiner

FIG.5

Test A: Condition of the writing tip in the applying part

| | Ex. 1 | Ex. 2 | Ex. 3 | Ex. 4 | Ex. 5 | Ex. 6 | Comp. Ex. 1 | Comp. Ex. 2 |
|---|---|---|---|---|---|---|---|---|
| Applicator [1] | No change | No change | No change | No change | No change | No change | No change | Slight bend at the tip end |
| Applicator [2] | No change | No change | No change | No change | No change | No change | No change | Light bend and fibers apart at the tip end |

* Example 3: part of the plastic mouthpiece tended to be in contact with the cap, so that the cap fitting was slightly tight.

FIG.6

Test B: Condition of the writing tip of the applying part

| | Ex. 1 | Ex. 2 | Ex. 3 | Ex. 4 | Ex. 5 | Ex. 6 | Comp. Ex. 1 | Comp. Ex. 2 |
|---|---|---|---|---|---|---|---|---|
| Applicator [1] | ◎ | ◎ | ◎ | ◎ | ○ | △ | × | × |
| Applicator [2] | ◎ | ◎ | ◎ | ◎ | △ | △ | ×× | × |
| Condition of condensation | None | Slight fogging inside cap | None | None | None | Slight fogging inside cap | A large amount of condensed water present | Condensed water present |
| S1/S2 | 0.27 | 0.27 | 0.18 | 0.25 | 0.31 | 0.37 | 0.66 | 0.42 |
| Space volume with cap fitted S1($mm^3$) | 94 | 94 | 56 | 83 | 114 | 147 | 500 | 180 |
| Volume inside cap including applicator S2($mm^3$) | 347 | 347 | 309 | 336 | 367 | 400 | 753 | 433 |

S1 : The volume of the air layer between the inner sleeve's inner peripheral surface and the outer peripheral surface of the applying part and plastic mouthpiece from the sealing structure S2 : The volume of the interior space of the inner sleeve from the sealing structure when the cap is removed from the barrel cylinder's front part ◎ : The same as in the initial state: application possible without blur.

○ : After about 1 mm of faint application, application possible the same as in the initial stage.

△ : After about 5 mm of faint application, application possible the same as in the initial stage.

X : After about 10 mm of faint application, application possible the same as in the initial stage.

XX : The entire applicator dried.

Comparative example 3

Comparative example 4

Comparative example 5

COSMETIC STORAGE TYPE APPLICATOR

TECHNICAL FIELD

The present invention relates to an applicator having a sharpened point in its applying part, in particular a so-called brush-type applicator having a brush-like application tip of bundled fibers in its front end, and relates to a cosmetic storage type applicator which, when its cap is fitted, protects its application tip against deformation etc. and is prevented from drying and dew condensation around the applicator.

The present invention also relates to a cosmetic storage type applicator for storing a fluid cosmetic, at least including an applying part, a reservoir element impregnated with cosmetic, a barrel cylinder for holding it and a cap and tail plug for keeping airtightness.

BACKGROUND ART

In the applicators having a sharpened point in the applying part (application tip), there is a pen-type cosmetic applicator having a brush-like application tip of bundled fibers and storing a cosmetic in a fluid form (slurry-like liquid or fluid containing fine solid particles).

These applicators are fitted with a so-called cylindrical cap, which is arranged so as to provide protection against drying and keep airtightness.

However, in ones that have a large space between the application tip and the interior of the cylindrical cap for containing cosmetics, especially eyeliner etc., which are blended with binders such as emulsion in order to keep the cosmetic long-lasting, the cosmetic may dry at the sharpened application tip, causing bad liquid delivery.

In order to prevent the above problem there has been an attempt to alleviate the degree of the above deficiency by attaching a so-called inner cap inside the cylindrical cap body. Caps of this type are composed of two or more parts made of an inner cap assembled inside a cap body.

When this cap is used, seamed steps will be formed between the inner peripheral surface of the cap body and the opening end of the inner cap. Such an applicator with its brush tip of sharpened, bundled fibers entails the problem that the brush tip may get caught by the seamed step or the sharpened end of the brush tip may be bent.

Also there occurs the problem that if dew condensation occurs due to change in temperature, the degree of drying at the application tip further increases.

Here, in Japanese Patent Application Laid-open Hei 11-129682 (patent document 1) and Japanese Patent Application Laid-open 2002-36781 (patent document 2) referred to as the prior art, there is a reference that has been known whereby in order to prevent the pen point from drying, an inner cap part having a small volume is provided inside the cap body, and that an absorbent material wetted with the used solvent is arranged inside the cap as a countermeasure. However, this prior art technique needs many parts hence is prone to increase cost. Further, this method when it is applied to a cap for cosmetic storage type applicator especially for eyeliner, needs hygienic care with regard to the absorbent material, hence entailing the problem of inconvenience in handling.

Also, Japanese Utility Model Application Laid-open Hei 6-66514 (patent document 3) discloses a cap with an inner cap, made up of at least three parts, in which the inner cap is movable. This configuration entails not only the problem that the brush hairs may be caught by the gap between the outer cap and inner cap but also the cost problem.

Japanese Patent Application Laid-open Hei 6-155980 (patent document 4) discloses a cap for a writing instrument, including an ink absorbent member of a continuously foamed material shaped with a hollow into which the tip of the pen core is inserted. This configuration entails a hygienic problem in handling the absorbent member, as a cap for a cosmetic storage type applicator for cosmetics, especially for eyeliner. Also, when the applicator is of a brush type made of bundled fibers, since the brush is not solidified like a pen core there occurs the problem that if the brush tip collides with the absorbent the brush tip may come apart so that the brush tip cannot come together when it used or may be crooked in the worst case, resulting in inability in use.

Furthermore, Japanese Utility Model Application Laid-open Hei 5-16381 (patent document 5) discloses a cap in which a small inner sleeve is formed so as to make the clearance between the inner surface of the inner sleeve and the pen element small, which can avoid the front end of the pen element abutting the cap interior and being damaged even if the pen element is long due to fluctuation, and which is characterized in that an abutted portion inside the cap is formed to be thin so that the abutted portion will deform.

However, when the applicator is of a brush type made of bundled fibers, since the brush is not solidified like a pen core, the brush tip may collide with the absorbent and come apart so that the brush tip cannot come together when it is used or may be crooked in the worst case, resulting in inability in use. Further, referring to the drawings in patent document 5, there is a step between inner sleeve (20) and covering element (10), which may give rise to a risk of the brush tip being bent.

Japanese Patent Application Laid-open Hei 7-228089 (patent document 6) provides a structure made of a cap (1, 101) and an inner cap (1, 103) with a stepped portion formed at its rear end of the press-fitting portion. When the applicator is of a brush type with a bundle of fibers, hairs may be caught by the boundary of the stepped portion. In addition, the space between the interior of the inner cap and the pen element has a large volume, based on the information in FIG. 3.

Japanese Patent Application Laid-open Hei 9-322819 (patent document 7) has the problem of the brush tip being caught between the inner cap, 48 and 49 when referring to FIG. 16 of the document (see FIG. 17 of the same).

Japanese Patent Application Laid-open Hei 10-416 (patent document 8) presents a structure of a cap and an inner cap, in which a step is formed at their press-fitting. When the applicator is of a brush type made of bundled fibers, there occur cases where the hairs are caught at that step. Further, the space between the interior of the inner cap and the pen element has a relatively large spatial volume, based on the information in FIG. 3. Further, in patent document 8, there is a fear that the brush tip is bent when the cap is fitted, as is apparent with reference to FIGS. 6 and 7.

In Japanese Patent Application Laid-open Hei 10-157381 (patent document 9), Japanese Patent Application Laid-open 2000-25385 (patent document 10) and Japanese Patent Application Laid-open 2001-121877 (patent document 11), with reference to the drawings of these, all of them have a stepped portion formed by a cap and an inner cap, and when the applicator is of a brush type made of bundled fibers, the hairs may be caught by it. Further, the space between the interior of the inner cap and the pen element is relatively large, based on the information in the drawings.

In an airtight cap for a pencil-type article, disclosed in Japanese Patent Application Laid-open 2001-252131 (patent document 12), a configuration including a pen element that is not of a brush type, with a large gap between the pen element and its inner cap.

Further, of the applicators with their tip of the applying part sharpened, there is a pen-like cosmetic storage type cosmetic tool that has a brush-like application tip made of bundled fibers and reserves a fluid cosmetic in a barrel cylinder.

A brush made of bundled fibers is arranged as the applying part at the front end of the barrel cylinder, a reservoir impregnated with cosmetic material being provided inside the barrel cylinder with a fiber-bundled core arranged so as to join the applying part and the reservoir to thereby lead the cosmetic material.

Further, a tail plug that produces airtightness for the barrel cylinder is arranged at the rear end of the barrel cylinder.

When the cosmetic material reserved is eyeliner for example, properties of quick drying after its application and long-lasting properties are demanded. Since it is applied to delicate area around eyes, the applicator preferably has a configuration that can be easy to operate as a whole. However, there are cases which have difficulties in regard to long-term storage performance due to the container shape and the air-sealing structure.

In particular, when the applicator is a brush having a brush tip of bundled fibers, the capillary force varies depending on the united condition of the brush fibers, though the fluid is suctioned partway through a reservoir and fiber-bundled core.

There is also an idea of making the brush longer as to its full length in order to shorten the fiber-bundled core that couples the brush and reservoir. In this case, however, there occurs the problem in that the distribution of the fluid becomes uneven since the fluid retaining force of the brush is low.

As a prior art technique relating to fluid cosmetic storage type applicators, in the fluid cosmetic storage type applicator disclosed in Japanese Utility Model Application Laid-open Sho 61-2814 (patent document 13), the length of the gripping portion defining the barrel outside diameter in the cylindrical body is indistinct in the drawings. Further, there exists a space in the tail plug portion where an elastic member for pressing the reservoir is accommodated.

In the fluid cosmetic storage type applicator disclosed in Japanese Utility Model Application Laid-open Sho 61-67615 (patent document 14), the outside diameter of the main barrel and the length of the gripping portion are indistinct in the drawings.

In Japanese Utility Model Application Laid-open Sho 63-139810 (patent document 15), the outside diameter of the main barrel and the length of the gripping portion are indistinct in the drawings. From its FIG. 1 the reservoir and the main barrel have approximately the same length.

In Japanese Patent Application Laid-open Hei 2-111303 (patent document 16), the outside diameter of the main barrel and the length of the gripping portion are indistinct in the drawings. Referring to its FIGS. 1 and 2 there is a large space in the rear part of the barrel.

In Japanese Patent Application Laid-open Hei 3-47112 (patent document 17), a barrel cylinder includes a tank part for directly storing the eyeliner fluid as a liquid and an air/liquid separator. That is, the components are quite different from the reservoir type.

Also, in Japanese Patent Application Laid-open 2002-241233 (patent document 18), the outside diameter of the main barrel and the length of the gripping portion are indistinct in the drawings.

PATENT DOCUMENT 1

Japanese Patent Application Laid-open Hei 11-129682

PATENT DOCUMENT 2

Japanese Patent Application Laid-open 2002-36781

PATENT DOCUMENT 3

Japanese Utility Model Application Laid-open Hei 6-66514

PATENT DOCUMENT 4

Japanese Patent Application Laid-open Hei 6-155980

PATENT DOCUMENT 5

Japanese Utility Model Application Laid-open Hei 5-16381

PATENT DOCUMENT 6

Japanese Patent Application Laid-open Hei 7-2280891

PATENT DOCUMENT 7

Japanese Patent Application Laid-open Hei 9-322819

PATENT DOCUMENT 8

Japanese Patent Application Laid-open Hei 10-416

PATENT DOCUMENT 9

Japanese Patent Application Laid-open Hei 10-157381

PATENT DOCUMENT 10

Japanese Patent Application Laid-open 2000-25385

PATENT DOCUMENT 11

Japanese Patent Application Laid-open 2001-121877

PATENT DOCUMENT 12

Japanese Patent Application Laid-open 2001-252131

PATENT DOCUMENT 13

Japanese Utility Model Application Laid-open Sho 61-2814

PATENT DOCUMENT 14

Japanese Utility Model Application Laid-open Sho 61-67615

PATENT DOCUMENT 15

Japanese Utility Model Application Laid-open Sho 63-139810

PATENT DOCUMENT 16

Japanese Patent Application Laid-open Hei 2-111303

PATENT DOCUMENT 17

Japanese Patent Application Laid-open Hei 3-47112

PATENT DOCUMENT 18

Japanese Patent Application Laid-open 2002-241233

DISCLOSURE OF INVENTION

Problems to be Solved by the Invention

The present invention has been achieved to solve the above problems, and relates to an applicator having a sharpened point in its applying part, in particular relating to so-called brush-type applicator made of bundled fibers, and it is an object of the present invention to provide a cosmetic storage type applicator, which protects its application tip against deformation etc. and which is prevented from drying and dew condensation around the applying part when the cap is fitted.

It is also another object of the present invention to provide a cosmetic storage type applicator which includes a cylindrical main barrel with an applying part capable of exhibiting a desired application performance, can secure airtightness while realizing easy-to-operate length for the user during application, is free from leakage of cosmetic even if a cosmetic material containing inorganic pigments and the like is used and even if its applying element is put downward, also prevents dew condensation between the rear end of the applying part and the front end of the reservoir element and between the rear end of the reservoir element and the tail plug and enables smooth drawing of fine lines during storage, and which is excellent in quality and sanitation, by preventing condensation of water that might propagate microbes depending on circumstances if a large amount of dew occurs since condensed water does not contain a preservative.

Means for Solving the Problems

The present invention is to provide a cosmetic storage type applicator for solving the above problems.

The first aspect of the present invention resides in a cosmetic storage type applicator having a structure for supplying a cosmetic to an applying part from the interior of a barrel cylinder, including: a barrel cylinder for storing a cosmetic; an applying part disposed at the front part of the barrel cylinder for applying the cosmetic to a target object; and a holding member for covering the applying part over the periphery thereof from the barrel cylinder side, leaving the tip part of the applying part exposed, characterized in that a cap removably attached to the front part of the barrel cylinder for covering the applying part and holding member is provided; an inner sleeve having a tapered inside diameter toward the front end is arranged inside the cap body and is integrally formed with the cap body; and the inner peripheral surface from the inner sleeve to the cap body is formed free from steps.

Here, the steps means portions with indentations and projections with respect to the inner peripheral surface, and do not include gentle up and down slopes such as a ridgeline where two surfaces join.

In the first aspect of the present invention, it is preferable that the cap includes an inner sleeve having an inner peripheral surface formed correspondingly to the outer peripheral surface of the applying part and holding member; and a substantially static air layer is created between the inner peripheral surface of the inner sleeve and the outer peripheral surface of the applying part and holding member when the cap is fitted to the front part of the barrel cylinder, covering the applying part and holding member.

In the first aspect of the present invention, it is preferable that the air layer between the inner sleeve's inner peripheral surface and the outer peripheral surface of the applying part and holding member has a volume of 50 $mm^3$ to 150 $mm^3$.

In the first aspect of the present invention, it is preferable that a volume ratio S1/S2 is specified to be 0.1 to 0.4, where S1 is the volume of the air layer between the inner sleeve's inner peripheral surface and the outer peripheral surface of the applying part and holding member from a sealing structure that keeps airtightness between the cap and barrel cylinder's front part when the cap is fitted to barrel cylinder's front part to cover the applying part and holding member; and S2 is the volume of the interior space of the inner sleeve from the sealing structure when the cap is removed from barrel cylinder's front part.

In the first aspect of the present invention, it is preferable that the cap is formed so that the outside base part of the inner sleeve is integrally jointed to the inside part of the cap body while a space is formed between the outer periphery of the inner sleeve other than the base part and the inner periphery of the cap body.

In the first aspect of the present invention, it is preferable that the applying part has a sharpened tip end.

In the first aspect of the present invention, it is preferable that the applying part is formed of a brush-like form of bundled fibers.

The second aspect of the present invention resides in a cosmetic storage type applicator having a structure for supplying a cosmetic to an applying part from the interior of a barrel cylinder, including: a barrel cylinder of a cylindrical main barrel that stores a fluid cosmetic absorbed in a reservoir; and an applying part disposed at the front part of the barrel cylinder for applying the cosmetic to a target object, characterized in that a cap removably attached to the front part of the barrel cylinder for covering the applying part and a tail plug for keeping airtightness inside the barrel cylinder are provided, the tail plug being arranged in contact with the rear end of the reservoir.

The third aspect of the present invention resides in a cosmetic storage type applicator, at least comprising: an applying part; a reservoir element impregnated with a cosmetic; a barrel cylinder for accommodating the reservoir element; and a cap and tail plug for keeping airtightness in the barrel cylinder, characterized in that the reservoir element impregnated with cosmetic having a full length between 30 mm and 50 mm is accommodated inside the barrel cylinder; and, inside the barrel cylinder a first tail plug is disposed at a position in contact with the rear end of the reservoir element for sealing the barrel cylinder interior air tightly from the outside air and a second tail plug is disposed behind the first tail plug at the position of the rear end of the barrel cylinder.

In the third aspect of the present invention, it is preferable that the first tail plug is formed continuously with the second tail plug.

In the third aspect of the present invention, it is preferable that a substantially cylindrical holding member for covering a feeder core that couples the applying part and the reservoir element for leading the cosmetic absorbed in the reservoir element to the applying part is arranged in substantially close contact around the feeder core in the front part of the barrel cylinder.

In the third aspect of the present invention, it is preferable that the coloring agent of the stored cosmetic at least contains a pigment.

In the third aspect of the present invention, it is preferable that the applying part is a brush-like form made of plural hair-like pieces.

It is preferable that the length of the brush element (brush) is between 10 mm to 20 mm. If the length of the brush element exceeds 20 mm, the aforementioned unevenness of fluid distribution becomes conspicuous. If the length of the brush element is 10 mm or below, the problem is alleviated but it becomes difficult to handle it and assemble it to the barrel cylinder. The length of the brush element is more preferably specified to be from 15 mm to 18 mm.

Effect of the Invention

According to the first aspect of the present invention, since an inner sleeve having a tapered inside diameter toward the front end is arranged inside the cap body and is integrally formed with the cap body, and the inner peripheral surface from the inner sleeve to the cap body is formed free from steps, there is no portion that bites the hairs even if the applying part is formed of a soft brush. Further, since an inner sleeve having a tapered inside diameter toward the front end is provided, even if a soft brush tip comes in contact with the inner periphery of the inner sleeve, there is no risk of the brush tip getting stuck or being bent or undergoing any deformation.

Accordingly, the durability of the applying part of the cosmetic storage type applicator is improved.

Further, since the cap includes an inner sleeve having an inner peripheral surface formed correspondingly to the outer peripheral surface of the applying part and holding member, and a substantially static air layer is created between the inner peripheral surface of the inner sleeve and the outer peripheral surface of the applying part and holding member when the cap is fitted to the front part of the barrel cylinder, covering the applying part and holding member, the air layer will be little moved even if the applicator is swayed or vibrated due to its being carried or the like. Accordingly, the cosmetic is unlikely to produce dew condensation on the inner sleeve's inner surface, hence the applicator is excellent in resistance against dew condensation of the application liquid.

Particularly, since a static air layer is created around and above the applying part, it is effective.

Further, in the first aspect of the present invention, when the air layer between the inner sleeve's inner peripheral surface and the outer peripheral surface of the applying part and holding member is specified to be 50 $mm^3$ to 150 $mm^3$ in volume, the writing tip is hard to dry even if an applicator has a sharpened tip different from a pen core, or in particular has an brush-like application tip made of bundled fibers or so-called hair pencil tip, which presents weak capillarity and cannot retain a large amount of fluid. Further, this configuration also makes the volatile component of the cosmetic hard to evaporate into the air layer inside the cap hence reliably prevent dew condensation from arising inside the cap even if the applicator has not been used for long time with its cap fitted. This operational effect was confirmed by the test results of the applicators of the present invention which will be described hereinbelow.

It is particularly preferable that, from 50 $mm^3$ to 150 $mm^3$, the volume of the air layer falls within the range from 80 $mm^3$ to 120 $mm^3$.

Further, in the first aspect of the present invention, when the cosmetic storage type applicator is specified so that the volume ratio S1/S2 is 0.1 to 0.4, where S1 is the volume of the air layer between the inner sleeve's inner peripheral surface and the outer peripheral surface of the applying part and holding member from a sealing structure for keeping airtightness between the cap and barrel cylinder's front part when the cap is fitted to barrel cylinder's front part to cover the applying part and holding member; and S2 is the volume of the interior space of the inner sleeve from the sealing structure when the cap is removed from barrel cylinder's front part, the writing tip is hard to dry even if an applicator has a sharpened tip different from a pen core, or in particular has a brush-like application tip made of bundled fibers or so-called hair pencil tip, which presents weak capillarity and cannot retain a large amount of fluid. Further, this configuration also makes the volatile component of the cosmetic hard to evaporate into the air layer inside the cap hence reliably prevent dew condensation from arising inside the cap even if the applicator has not been used for long time with its cap fitted. This operational effect was confirmed by the test results of the applicators of the present invention which will be described hereinbelow.

Further, in the first aspect of the present invention, when the cap is formed so that the outside base part of the inner sleeve is integrally jointed to the inside part of the cap body while a space is formed between the outer periphery of the inner sleeve other than the base part and the inner periphery of the cap body, this space provides a function of an adiabatic layer so that it is possible to prevent thermal conduction of heat from the outside air, hence reliably prevent the applying part from being dried by heat from the outside air.

In the first aspect of the present invention, even if the applying part is formed with a sharpened tip the tip is unlikely to be bent when the tip comes into contact with the interior of the cap's inner sleeve because there is no step. Further, in the present invention, even if the applying part is formed with a brush-like form of bundled fibers, the brush-like tip will not be bitten or will not come apart since the inner sleeve of the cap is integrally formed without any step therein.

According to the cosmetic storage type applicator of the second aspect of the present invention, it is possible to provide a cap that is removably attached to the front part of the barrel cylinder for covering the aforementioned applying part and a tail plug for keeping airtightness inside the barrel cylinder so that the tail plug can be arranged in contact with the rear end of the reservoir.

As a result, it is possible to secure airtightness with the tail plug even if the length of the barrel cylinder is made longer relative to the reservoir element, taking into consideration the ease of gripping and writing for the user because the tail plug can be set distant from the position of the rear end of the barrel cylinder. Hence it is possible to provide a cosmetic storage type applicator which can secure airtightness while realizing easy-to-operate length for the user during application, is free from leakage of cosmetic even if a cosmetic that contains inorganic pigments and the like is used and even if its applying element is put downward, also prevents dew condensation between the rear end of the applying part and the front end of the reservoir element and between the rear end of the reservoir element and the tail plug and enables smooth drawing of fine lines during storage, and which is excellent in quality and sanitation, by preventing condensation of water that might propagate microbes depending on circumstances if a large amount of dew condensation occurs since condensed water does not contain a preservative.

Further, according to the cosmetic storage type applicator of the third aspect of the present invention, in a cosmetic storage type applicator including a cap and tail plug for keeping airtightness in the barrel cylinder, a reservoir element impregnated with cosmetic having a full length between 30 mm and 50 mm is accommodated inside the barrel cylinder, and inside the barrel cylinder a first tail plug is disposed at the position in contact with the rear end of the reservoir element for sealing the barrel cylinder interior airtightly from the outside air and a second tail plug is disposed behind the first tail plug at the position of the rear end of the barrel cylinder.

As a result, it is possible to secure airtightness with the first tail plug even if the length of the barrel cylinder is made longer relative to the reservoir element though the full length of the reservoir element is between 30 mm and 50 mm, taking into consideration the ease of gripping and writing for the user because the first and second tail plugs can be set distant from each other. Hence it is possible to provide a cosmetic storage type applicator which can secure airtightness while realizing easy-to-operate length for the user during application, is free from leakage of cosmetic even if a cosmetic that contains inorganic pigments and the like is used and even if its applying element is put downward, also prevents dew condensation between the rear end of the applying part and the front end of the reservoir element and between the rear end of the reservoir element and the tail plug and enables smooth drawing of fine lines during storage, and which is excellent in quality and sanitation, by preventing condensation of water that might propagate microbes depending on circumstances if a large amount of condensed water occurs since condensed water does not contain a preservative.

Here in the third aspect of the present invention, when the first tail plug is formed continuously with the second tail plug, it is possible to reduce the total number of parts for the applicator by forming the first tail plug and second tail plug as a single part, hence it is possible to set the first tail plug and second tail plug at the same time, realizing easy assembly. No condensed water etc. will be generated in the space between the rear of the first tail plug and the second tail plug. Also, there is no fear of propagation of microbes.

Further, when a substantially cylindrical holding member for covering a feeder core that couples the applying part and the reservoir element for leading the cosmetic absorbed in the reservoir element to the applying part is arranged in substantially close contact around the feeder core in the front part of the barrel cylinder, generation of condensed water around the feeder core in the space between the applying part and the reservoir element decreases, and the solvent and the like will not depart from the reservoir element that retains the cosmetic, hence it is possible to alleviate change of the cosmetic composition.

Preferably, the holding member is a resin molding having a low moisture permeability. The transport core may be selected from various forms such as a structure made up of bundled fibers, a structure of continuously foamed material or the like as long as it can lead the cosmetic.

The coloring agent of the stored cosmetic in the aforementioned reservoir element may at least contain a pigment. Also, the applying part may be a brush-like form made of plural hair-like pieces.

BRIEF DESCRIPTION OF THE DRAWINGS

FIG. 5 is an illustrative chart showing the test result of examples 1 to 6 of the present invention in comparison with comparative examples 1 and 2.

FIG. 6 is an illustrative chart showing the test result of examples 1 to 6 of the present invention in comparison with comparative examples 1 and 2.

DESCRIPTION OF REFERENCE NUMERALS

Figure 1:
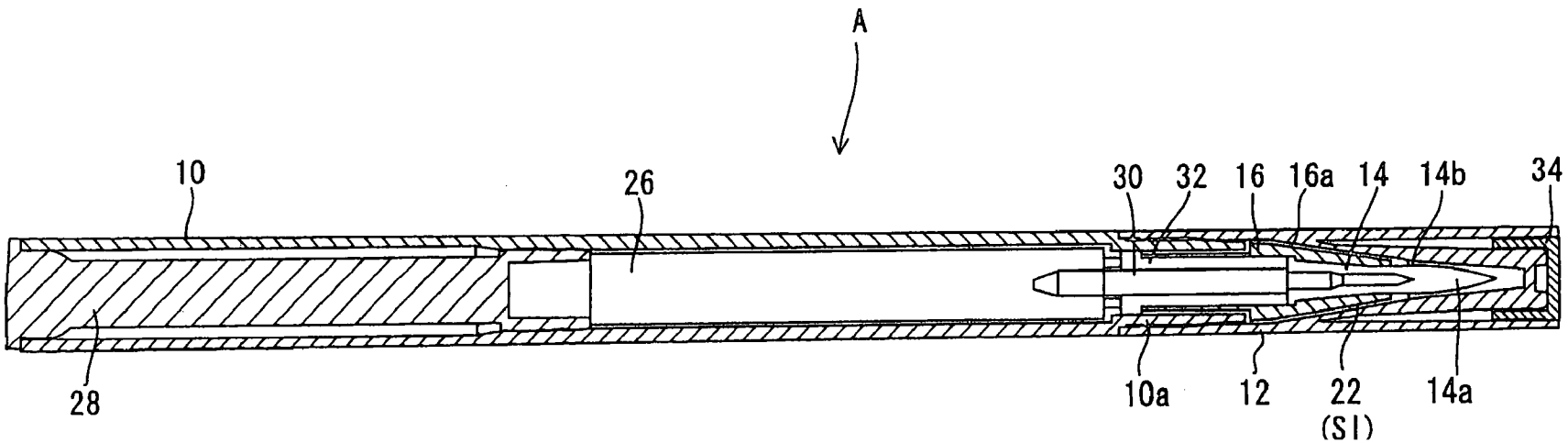
FIG. 1 is an illustrative view showing a vertical section of an overall configuration of a cosmetic storage type applicator A according to the embodiment of the present invention with a cap fitted in the front part of the barrel cylinder.

10 barrel cylinder
10*a* barrel cylinder's front part
10*b* annular rib (sealing structure)
12 cap
14 applying part
14*a* tip end
14*b* outer peripheral surface
14*c* rear end
16 plastic mouthpiece (holding member)
16*a* outer peripheral surface
18 cap body
18*a* cap body front end
18*b* cap body inner peripheral surface
20 inner sleeve
20*a* front part
20*b* inner peripheral surface
22 air layer
26 reservoir
28 tail plug
30 ink transport core (feeder core)
32 supporter
34 crown cap
36 space (adiabatic air layer, substantially static air layer)
38*a* annular rib (sealing structure)
38*b* dotted rib
A cosmetic storage type applicator
110 applying part
112 reservoir element
114 cylindrical main barrel (barrel cylinder)
114*a* front part
114*b* gripping portion
116 cap
116*a* cap body
116*b* inner sleeve
116*c* ornamental plug
118A first tail plug (the second embodiment)
118B second tail plug
118 one-piece type tail plug (the third embodiment)
118C first tail plug
118D second tail plug
118E rod portion
118*f* rib
118*g* flange
120 feeder core (ink transport core)
122 holding member (spacer)
124 plastic mouthpiece
d1 inside diameter
d2 inside diameter

BEST MODE FOR CARRYING OUT THE INVENTION

Next, the embodiment modes of the present invention will be described with reference to the accompanying drawings.

FIGS. 1 to 6 show an embodiment of a cosmetic storage type applicator according to the present invention, in which those allotted with the same reference numerals indicate the same components.

Figure 2:
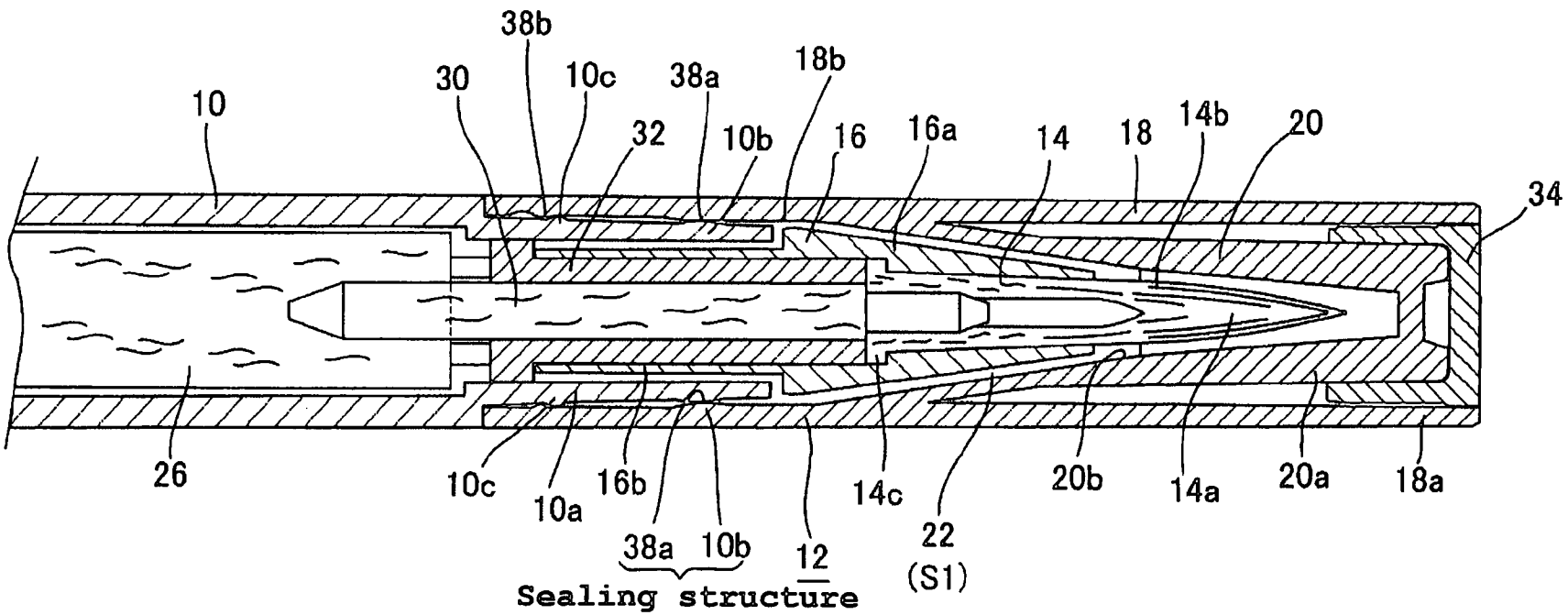
FIG. 2 is a detail illustrative view around the front part of barrel cylinder of cosmetic storage type applicator A in FIG. 1 with its cap fitted.
Figure 3:
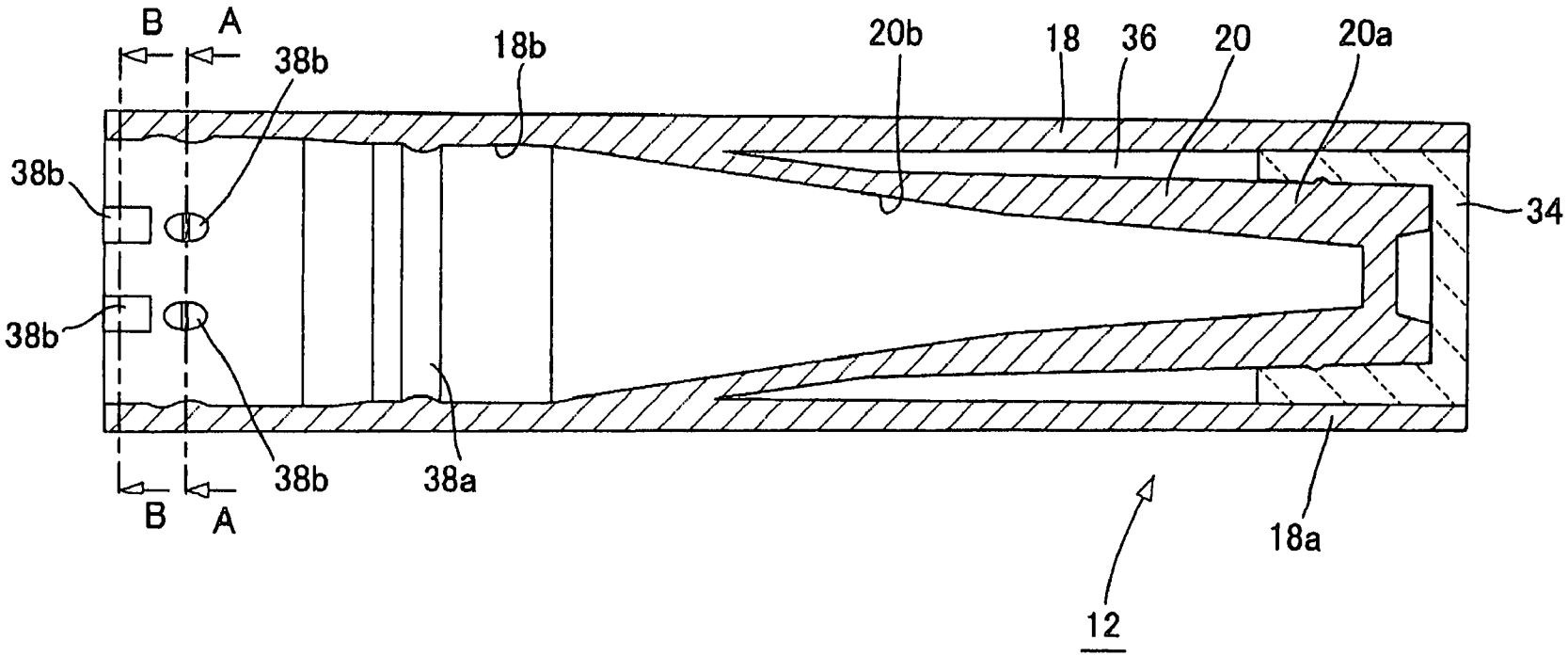
FIG. 3 is an illustrative view showing a vertical section of the cap alone.

Specifically, FIG. 1 is an illustrative view showing a vertical section of an overall configuration of a cosmetic storage type applicator A with a cap 12 fitted in the front part (barrel cylinder's front part) 10*a* of a barrel cylinder 10; FIG. 2 is a detailed illustrative view around the front part of barrel cylinder 10 in cosmetic storage type applicator A in FIG. 1 with cap 12 fitted; FIG. 3 is an illustrative view showing a vertical section of cap 12 alone; and FIGS. 4(*a*) and 4(*b*) are illustrative views showing cross sections of the cap 12 cut along lines A-A and B-B shown in FIG. 3, respectively.

FIGS. 5 and 6 are illustrative charts showing the test result of examples 1 to 6 of the present invention in comparison with comparative examples 1 and 2.

As shown in FIGS. 1 and 2, cosmetic storage type applicator A is a cosmetic storage type applicator which has a structure including: barrel cylinder 10 holding a reservoir 26 impregnated with a cosmetic; an applying part 14 disposed at a front part 10*a* of the barrel cylinder for applying the cosmetic to a target; and aplastic mouthpiece (holding member) 16 that covers the periphery of applying part 14 on its barrel cylinder 10 side (proximal side) exposing a tip end 14*a* of the applying part 14 so as to supply the cosmetic in barrel cylinder 10 to applying part 14, and further includes cap 12 which can be removably fitted to barrel cylinder's front part 10*a* to cover the applying part 14 and plastic mouthpiece 16.

As shown in FIGS. 2 and 3, cap 12 is integrally formed of a hollow cylindrical body (which will be referred to hereinbelow as "cap body") 18 forming its external periphery and an inner sleeve 20 that has a inside diameter tapered toward its front part 20*a* and is formed integrally with and inside cap body 18, with the inner peripheral surface (also called "inner wall surfaces") of the inner sleeve 20 and cap body 18, designated at 20*b* and 18*b*, formed smoothly without steps.

The aforementioned cap 12 has inner sleeve 20 having an inner peripheral surface formed correspondingly to the configuration of outer peripheral surfaces 14*b* and 16*a* of applying part 14 and plastic mouthpiece 16 when the cap is fitted in barrel cylinder's front part 10*a*, and the cap forms a substantially static air layer 22 between inner sleeve's inner peripheral surface 20*b* and the outer peripheral surfaces 14*b* and 16*a* of applying part 14 and plastic mouthpiece 16 when cap 12 is fitted to barrel cylinder's front part 10*a* to cover applying part 14 and plastic mouthpiece 16.

Air layer 22 between inner sleeve's inner peripheral surface 20*b* and the outer peripheral surfaces 14*b* and 16*a* of applying part 14 and plastic mouthpiece 16 has a volume of 50 $mm^3$ to 150 $mm^3$, preferably 80 $mm^3$ to 120 $mm^3$. Here, inner sleeve's inner peripheral surface 20*b* can be appropriately designed so that the surface corresponding to plastic mouthpiece 16 becomes narrower with an angle (taper angle) of about 32 to 40 degrees and the surface corresponding to applying part 14 becomes narrower with an angle (taper angle) of about 4 to 28 degrees.

Further, it is preferable that the volume ratio S1/S2 is 0.1 to 0.4, where S1 is the volume of air layer 22 between the inner sleeve 20's inner peripheral surface and outer peripheral surfaces 14*b* and 16*a* of applying part 14 and plastic mouthpiece 16 from the sealing structure (an annular rib 10*b* in barrel cylinder's front part 10*a* and annular rib 38*a* in the inner peripheral surface of cap 12 to be described later: to be exact, the joint position between these) for keeping airtightness between cap 12 and barrel cylinder's front part 10*a* when cap 12 is fitted to barrel cylinder's front part 10*a* to cover applying part 14 and plastic mouthpiece 16, and S2 is the volume of the interior space of the inner sleeve (located in the front part in the axial direction in the embodiment) from the sealing structure (annular rib 38*a*) when cap 12 is removed from barrel cylinder's front part 10*a*.

Applying part 14 is so formed that its tip end 14*a* is sharpened. Further, applying part 14 is in the brush-like form of bundled fibers. Specifically, applying part 14 is formed like a brush of a bundle of a plural resin fibers (as a specific example: fibers of polybutyleneterephthalate (PBT) of 0.1 to 0.14 mm thick) such that its tip end 14*a* is trimmed into taper (sharpened) and its rear end 14*c* is lumped into a flange of a greater diameter by thermal welding. Here, applying part 14 may also be a fabric solid as another example.

Here, in the cosmetic storage type applicator of the embodiment, reservoir 26 as an ink absorbent member is accommodated from the middle part to front part 10*a* inside barrel cylinder 10 as shown in FIGS. 1 and 2. Reservoir 26 is sealed and supported by a tail plug 28 that is fitted from the rear end of barrel cylinder 10.

An ink transport core 30 made of continuously foamed material is disposed in the opening of barrel cylinder's front part 10*a*. This transport core 30 is arranged with its rear end fitted into the front part of reservoir 26 and its front end fitted into the rear end of applying part 14 so as to lead ink absorbed in reservoir 26 to applying part 14. Transport core 30 is fitted into barrel cylinder's front part 10*a* that is reduced in diameter forming a step with the main part (reduced in diameter by the thickness of cap 12) with an approximately cylindrical supporter 32 in-between while the cylindrical rear part of plastic mouthpiece 16 is inserted into and between the outer periphery of supporter 32 and inner periphery of barrel cylinder's front part 10*a*.

The front part of plastic mouth piece 16 is located in front of barrel cylinder's front part 10*a* so as to cover peripheral surface 14*b* of applying part 14, with its outer peripheral surface 16*a* is formed conically or tapered toward its distal end.

Figure 4A:
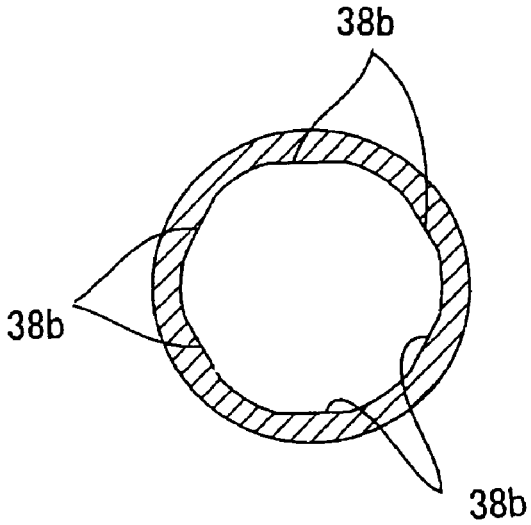
FIGS. 4(*a*) and 4(*b*) are illustrative views showing cross sections of the cap cut along lines A-A and B-B shown in FIG. 3, respectively.
Figure 4B:
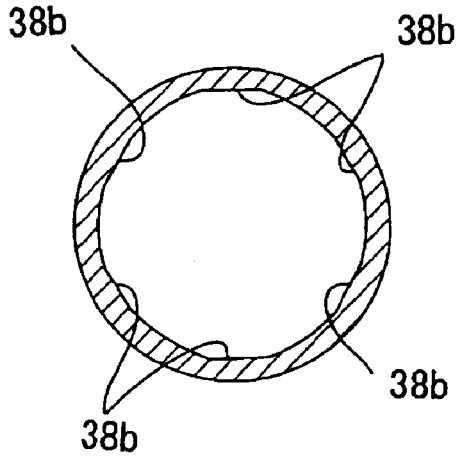

As shown in FIGS. 2 to 4, in cap 12, cap body 18 is formed in a substantially cylindrical shape having a necessary thickness with a cup-like crown cap 34 fitted into open front end 18*a*, thereby the crown cap 34 forming a hermetic space 36 between cap body 18 and inner sleeve 20.

Detailedly, inner sleeve 20 is jointed to cap body 18 from its middle part to the rear. Front part 20*a* of inner sleeve 20 becomes narrower or tapered toward the end in the inner periphery, whereas the outer peripheral surface of the front part 20*a* is tapered gently, in a more cylinder-like fashion.

Accordingly, space 36 formed between the inner peripheral surface in the cap body 18's front part and the outer peripheral surface of inner sleeve's front part 20*a* is narrow in some degree, and the open end of the space 36 is enclosed by the aforementioned crown cap 34 so as to form a substantially static air layer. This space 36 functions as an adiabatic air layer that prevents heat conduction from the external atmosphere from transferring to air layer 22 inside inner sleeve 20.

In the inner peripheral surface of cap 12 on its rear side, annular rib 38*a* is formed around the inner circumference at a position away and forward from the rear end of cap 12 and a plurality of dotted ribs 38*b*, 38*b* . . . are formed along the rear end of cap 12 and apart from each other (e.g., six dotted ribs 38*b* formed equi-distantly) in the circumferential direction.

Further, formed on the outer peripheral surface of barrel cylinder's front part 10*a* are annular ribs 10*b* and 10*c* that fit and engage the aforementioned annular rib 38*a* and dotted ribs 38*b*, 38*b* . . . when cap 12 is fitted (see FIG. 2).

Specifically, annular rib 10*b* in barrel cylinder 10 and annular rib 38*a* in cap 12 are constructed so as to realize a sealing structure that keeps airtightness between cap 12 and barrel cylinder's front part 10*a* by forming close fitting between annular rib 38*a* of cap 12's inner peripheral surface and annular rib 10*b* of the periphery of barrel cylinder's front part 10*a* when cap 12 is fitted to barrel cylinder's front part 10*a* to cover applying part 14 and plastic mouth piece 16.

Similarly, when cap 12 is fitted to barrel cylinder's front part 10*a*, annular rib 10*c* of barrel cylinder 10 and dotted ribs 38*b* of cap 12 closely fit and engage each other as well as annular ribs 10*b* and 38*a*, forming an anti-removal structure for preventing cap 12 from falling from barrel cylinder 10 even if an accidental force is acted thereon while the aforementioned cosmetic storage type applicator is being carried. Dotted ribs 38*b* of cap 12 are arranged in multiple rows, of which one row on the forward side engages the aforementioned annular rib 10*c*, while another row on the rear side closely fit to the outer wall surface of barrel cylinder's front part 10*a*, thus forming a structure contributing to anti-falling of cap 12 (see FIGS. 3 and 4).

Next, examples 1 to 6 of cosmetic storage type applicators of the embodiment will be described and the result compared with comparative examples 1 and 2 will be described based on FIGS. 5 and 6.

Example 1

In example 1, cap 12 of cosmetic storage type applicator according to the embodiment was constructed so that substantially static air layer 22 that was formed between inner sleeve's inner peripheral surface 20*b* and the outer peripheral surfaces of applying part 14 and plastic mouthpiece (holding member) 16 when the cap was fitted to barrel cylinder's front part 10*a* to cover applying part 14 and plastic mouthpiece 16 was created with its space volume S1 of air layer 22 from the sealing structure (annular rib 10*b* of barrel cylinder 10 and annular rib 38*a* of cap 12) set at about 94 $mm^3$. The spatial volume of space 36 of adiabatic air layer (substantially static air layer) enclosed by crown cap 34 was about 180 $mm^3$. The volume S2 of the interior part of inner sleeve 20 of cap 12 from the aforementioned sealing structure (annular rib 38*a*) when cap 12 was not fitted to barrel cylinder 10 was 347 $mm^3$. The volume ratio S1/S2 was 0.27.

Example 2

The applicator in this example 2 is the one from the above example 1 from which crown cap 34 and space 36 of adiabatic air layer (substantially static air layer) were omitted. Similarly to example 1, space volume S1 of the air layer 22 was set at about 94 $mm^3$, the interior volume S2 of inner sleeve 20 of cap 12 from the aforementioned sealing structure (annular rib 38*a*) was 347 $mm^3$, hence the volume ratio S1/S2 was 0.27.

Example 3

In example 3, space volume S1 of the air layer 22 when cap 12 was fitted was about 56 $mm^3$. The interior volume S2 of inner sleeve 20 of cap 12 from the aforementioned sealing structure (annular rib 38*a*) when cap 12 was not fitted to barrel cylinder 10 was 309 $mm^3$. The volume ratio S1/S2 was 0.18. Other than the above, space 36 of the adiabatic air layer (substantially static air layer) was omitted similarly to example 2.

Example 4

In example 4, space volume S1 of the air layer 22 when cap 12 was fitted was about 83 $mm^3$. The interior volume S2 of inner sleeve 20 of cap 12 from the aforementioned sealing structure (annular rib 38*a*) when cap 12 was not fitted to barrel cylinder 10 was 336 $mm^3$. The volume ratio S1/S2 was 0.25. The others were specified similarly to example 1.

Example 5

In example 5, space volume S1 of the air layer 22 was about 114 $mm^3$. The interior volume S2 of inner sleeve 20 of cap 12 from the aforementioned sealing structure (annular rib 38*a*) when cap 12 was not fitted to barrel cylinder 10 was 367 $mm^3$. The volume ratio S1/S2 was 0.31. The others were specified similarly to example 1.

Example 6

In example 6, space volume S1 of the air layer 22 was about 147 $mm^3$. The interior volume S2 of inner sleeve 20 of cap 12 from the aforementioned sealing structure (annular rib 38*a*) when cap 12 was not fitted to barrel cylinder 10 was 400 $mm^3$. The volume ratio S1/S2 was 0.37. The others were specified similarly to example 1.

Comparative Example 1

Comparative example 1 uses a barrel cylinder of the same configuration as that of barrel cylinder 10 of the above cosmetic storage type applicator, and its barrel cylinder's front part is fitted with a cylindrical cap having a different configuration from the cap of the above embodiment. The space volume S1 between this and the plastic mouthpiece and applying part from the sealing structure formed by the rib on the cap's inner periphery and the rib on the barrel cylinder's outer periphery was about 500 $mm^3$. The interior volume S2 from the rib on the cap's inner periphery when the cap was not fitted to the barrel cylinder was 753 $mm^3$. The volume ratio S1/S2 was 0.66.

Comparative Example 2

An inner sleeve having a shape approximately corresponding to the configuration of the applicator and plastic mouthpiece is fitted as a separate part inside a cylindrical cap. The space volume S1 formed with the plastic mouthpiece and applying part from the sealing structure formed by the rib on the cap's inner periphery and the rib on the barrel cylinder's outer periphery was about 180 $mm^3$. The interior volume S2 from the rib on the cap's inner periphery when the cap was not fitted to the barrel cylinder was 433 $mm^3$. The volume ratio S1/S2 was 0.42. The others were specified similarly to comparative example 1.

In the test, an eyeliner fluid consisting of, 15 parts of sintered titanium and titanium oxides,
3.5 parts of acrylic alkyl copolymer,
10 parts 1.3 butylene glycol,
0.5 parts of phenoxyethanol,
0.2 part of methyl para-hydroxybenzoate,
0.2 part of ethyl para-hydroxybenzoate,
0.6 part of 2-amino-2-methyl-1-propanol, 0.1 part of di-sodium edetate,
5 parts of acrylic alkyl copolymer ammonium (emulsion solids 40%),
and 65 parts of purified water,
in total 100 parts,
was charged, 1 gram each, into each of the barrel cylinders of the above examples 1 to 6 and comparative example 1 and 2, to prepare brush-type cosmetic storing products with associated caps of examples 1-6 and comparative examples 1-2 fitted, as test samples.

Test A: the cap of each test sample was removed by the right hand and then fitted by the left hand, and the opposite actions were done. These actions were repeated alternately, 100 times in total.

The test was done using two types of applying parts (applicators): applicator [1] having a sharpened tip of a core formed by solidifying polyester fibers with a binder; and applicator [2] of a brush formed of bundled fibers.

Test B: test samples were left for one month in a thermostat chamber with 12-hour cycles of 0 deg. centigrade and 40 deg. centigrade, then the application tips were observed with their caps removed.

The test results are shown in FIGS. 5 and 6.

As shown in FIG. 5, the result from test A shows that the applying parts of examples 1 to 6 presented no bend or separations at their tip ends and could be used for application without problem even after the repeated attachment and removal of their caps.

In contrast, though comparative example 1 did not present any problem, in comparative example 2, applicator [1] presented a bend, and applicator [2] presented not only a bend but also caused difficulties in use because of separations.

The result of test B did not present significant problems in application performance in any of examples 1 to 6 as shown in FIG. 6. Specifically, during application in examples 1 to 4, application could be done in the same manner as in the initial condition. In example 5, in application with applicator [1], application could be done in the same manner as in the initial state after about 1 mm in length of faint application. With applicator [2] in example 5 and applicators [1] and [2] in example 6, application could be done in the same manner as in the initial state after about 5 mm in length of faint application.

As to dew condensation, any of examples 1 to 6 did not present significant problems. Detailedly, in example 2 and example 6, though slight fogging appeared inside the cap, external appearance quality was good. In other examples 1, 3 to 5, no fogging occurred at all.

In contrast, in application with applicator [1] in comparative example 1 and in application with applicators [1] and [2] in comparative example 2, application equivalent to the initial state could be done only after an application of about 10 mm in length. With applicator [2] in comparative example 1, the applying part dried, being unable to achieve any application. Continuation of a faint application of about 10 mm in length means a situation in which makeup will not apply without rubbing the minute area in the face several times, hence posing inconvenience in usability.

As to dew condensation, any of comparative examples 1 and 2 posed a problem of producing a large amount of condensed water.

From the above, in examples 1 to 6 embodying the present invention, it was confirmed that the applying part is little affected if the cap is fitted and removed and that no drying and condensed water problem with the applying part occurs after the applicator with its cap fitted has been left. Hence, the validity of the present invention was verified.

Next, the second embodiment and third embodiment of the present invention will be described herein below with reference to the accompanying drawings.

Figure 7:
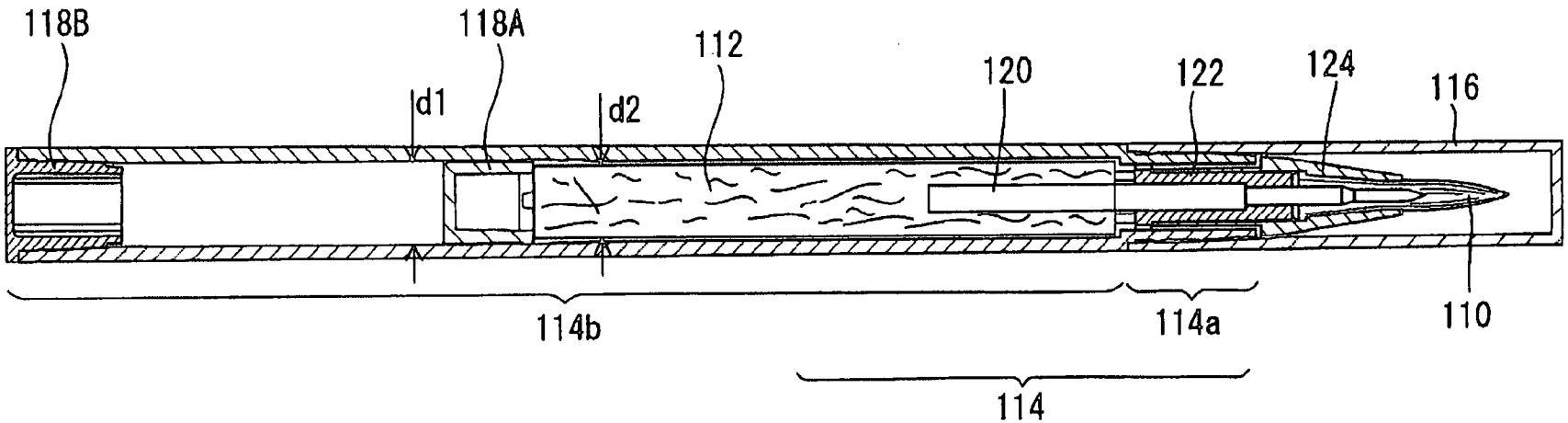
FIG. 7 is an illustrative view showing a vertical section of a second embodiment of a fluid cosmetic storage type applicator according to the present invention.
Figure 8:
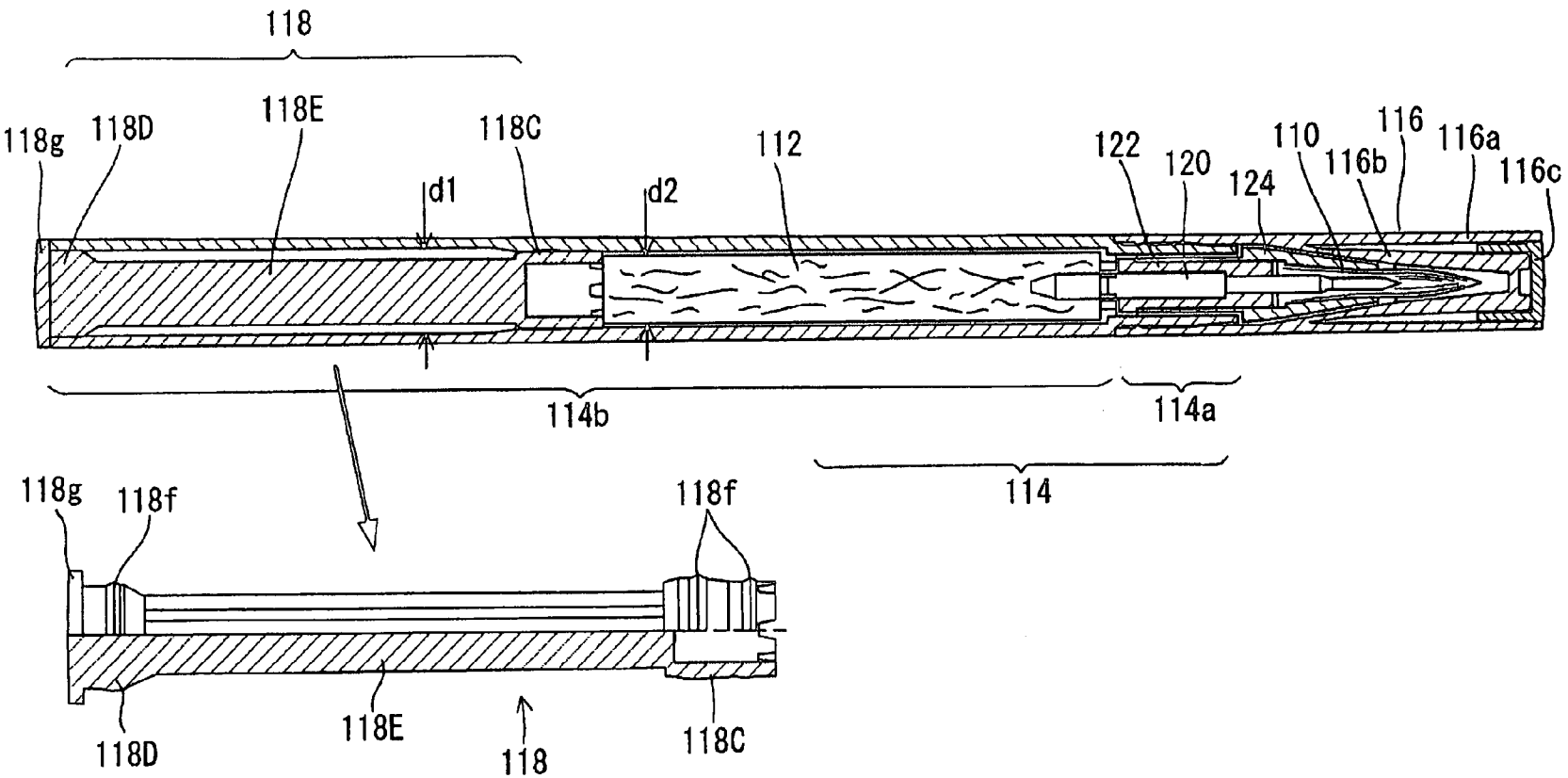
FIG. 8 is an illustrative view showing a vertical section of a third embodiment of a fluid cosmetic storage type applicator according to the present invention.

FIGS. 7 and 8 show the second and third embodiments of fluid cosmetic storage type applicators of the present invention. In the drawings, those allotted with the same reference numerals indicate identical components.

As shown in FIG. 7, fluid cosmetic storage type applicator according to the second embodiment includes: an applying part 110; a reservoir element 112 impregnated with cosmetic; a cylindrical main barrel (corresponding to "barrel cylinder") 114; a cap 116 for keeping airtightness around applying part 110 of cylindrical main barrel 114; and first tail plug 118A and second tail plug 118B arranged at the front and rear for keeping airtightness in the rear of the reservoir inside cylindrical main barrel 114.

Reservoir element 112 impregnated with cosmetic and having a full length of 30 mm to 50 mm is accommodated in cylindrical main barrel 114. Inside cylindrical main barrel 114, first tail plug 118A for keeping the interior of cylindrical main barrel 114 airtight from the outside air is arranged at a position in contact with the rear end of reservoir element 112 and second tail plug 118B is arranged behind it at a position of the rear end of cylindrical main barrel 114.

Here, the function of keeping the interior of cylindrical main barrel 114 airtight with first tail plug 118A and second tail plug 118B is the same as first tail plug 118C and second tail plug 118D (having a flange 118*g* at its rear end) of a one-piece type tail plug 118 in the fluid cosmetic storage type applicator according to the third embodiment which will be described with reference to FIG. 8. The interior of cylindrical main barrel 114 for securing airtightness is constructed as follows.

That is, the inside diameter of the interior of cylindrical main barrel 114 has different inside diameters d1 and d2: d1 for the portion from the vicinity of the position where first tail plug 118A or 118C creates airtightness inside cylindrical main barrel 114 (the position where the plug forms intimate contact to seal air) toward second tail plug 118B or 118D; and d2 for the portion from the vicinity of the position where first tail plug 118A or 118C creates airtightness inside cylindrical main barrel 114 toward applying part 110.

Specifically, in order to relieve air that would be urged toward applying part 110 and compressed by first tail plug 118A or 118C to the rear of first tail plug 118A or 118C (toward second tail plug 118B or 118D) when first tail plug 118A or 118C is inserted into cylindrical main barrel 114, d1 in the portion from the vicinity of the position where first tail plug 118A or 118C creates airtightness inside cylindrical main barrel 114 toward second tail plug 118B or 118D is formed greater than d2 in the portion from the vicinity of the position where first tail plug 118A or 118C creates airtightness inside cylindrical main barrel 114 toward applying part 110 (d1>d2).

With this arrangement, it is possible to prevent the cosmetic from rushing out or other problems due to compressed air when first tail plug 118A or 118C is fitted.

Further, a feeder core 120 that couples applying part 110 with reservoir element 112 for leading the cosmetic absorbed in reservoir element 112 to applying part 110 is provided inside the front part 114*a* of cylindrical main barrel 114. Also, a substantially cylindrical holding member (also called "spacer") 122 for covering the feeder core 120 in close contact around it is arranged inside front part 114*a* of cylindrical main barrel 114.

Here, front part 114*a* of cylindrical main barrel 114 is located in front of a gripping portion 114*b* in which reservoir element 112 is accommodated, and the outside diameter of the front part 114*a* is smaller than the outside diameter of the gripping portion 114*b*.

In front of holding member 122 and also in front of front part 114*a* of cylindrical main barrel 114, aplastic mouthpiece 124 as an exterior protector or ornament is arranged to cover applying part 110 halfway.

In front part 114*a* of cylindrical main barrel 114, a removable cap 116 that covers all the applying part 110, holding member 122, plastic mouthpiece 124 and the front part 114 is fitted. Cap 116 has an approximately cylindrical shape with its front end closed.

The coloring agent of the cosmetic absorbed in reservoir element 112 and stored in cylindrical main barrel 114 at least contains a pigment. A cosmetic including pigments is unlikely to fade, is stable, and is also preferable from a safety viewpoint.

Applying part 110 is a brush type element of plural hair-like pieces. This applying part 110 has a hollow in its center into which the front end of feeder core 120 is inserted.

Cylindrical main barrel 114, cap 116, first tail plug 118A, second tail plug 118B and plastic mouthpiece 124 are moldings of resin.

Reservoir element 112 is made of a natural or artificial fabric material and given in a cylindrical form.

Feeder core 120 is fitted into the front end of reservoir element 112 and leads the cosmetic to applying part 110 by its capillary force. In the embodiment, natural or artificial fabric material is shaped in a cylindrical and stepped form.

In the second embodiment, first tail plug 118A and second tail plug 118B are given separately. Of these, first tail plug 118A is constructed so that its cup-like opening is positioned in close contact with the rear end of reservoir element 112 and the outer peripheral surface of first tail plug 118A is arranged in intimate contact with the inner peripheral surface of cylindrical main barrel 114 to keep airtightness. Second tail plug 118B is airtightly fitted so as to enclose the opening at the rear end of gripping portion 114*b* of cylindrical main barrel 114. Accordingly, the space between first tail plug 118A and second tail plug 118B inside cylindrical main barrel 114 is kept airtight so that inconvenience such as dew condensation etc. will not occur.

In addition, in order to release air that would be urged toward applying part 110 and compressed by first tail plug 118A or 118C to the rear of first tail plug 118A or 118C (toward second tail plug 118B or 118D) when first tail plug 118A or 118C is inserted into cylindrical main barrel 114, d1 in the portion from the vicinity of the position where first tail plug 118A or 118C creates airtightness inside cylindrical main barrel 114 toward second tail plug 118B or 118D is formed greater than d2 in the portion from the vicinity of the position where first tail plug 118A or 118C creates airtightness inside cylindrical main barrel 114 toward applying part 110 (d1>d2).

With this arrangement, it is possible to prevent the cosmetic from rushing out or other problems due to compressed air when first tail plug 118A or 118C is fitted.

Each of the components will be described specifically.

Cylindrical main barrel 114 is formed so that its gripping portion 114*b* is 9 mm or smaller in outside diameter.

The full length of gripping portion 114*b*, i.e., the part of cylindrical main barrel 114 coupled with applying part 110 and feeder core 120 except the part covered by cap 116, is preferably 60 mm to 150 mm.

That is, the full length of gripping portion 114*b* is not smaller than 60 mm and not greater than 150 mm. If the gripping portion 114*b* is smaller than 60 mm, the grip is prone to be held with the tips of fingers, so application is prone to be unstable when lines are drawn in minute areas such as areas between eyelashes. In contrast, if it is equal to or greater than 60 mm, the gripping is not only held by the tips of fingers but also part of cylindrical main barrel 114 abuts another place such as the palm, root of the fingers etc., so as to make it easy to draw stable lines. On the other hand, if gripping portion 114*b* exceeds 150 mm, it is too long to use, and also, it is inconvenient to carry about and store it into a vanity case, etc. Gripping portion 115*b* is particularly preferably 70 mm or longer and 120 mm or shorter.

The length from the applying tip of applying part 110 to gripping portion 114*b* is designed to be about 30 mm.

Examples of pigments as coloring agents when the cosmetic stored is for eyeliner fluids, includes: oxides such as titanium oxide, zinc oxide, Indian red, chromium oxide, black iron oxide, yellow iron oxide and the like, sintered pigments such as titanium black, lithium cobalt titanate, sintered iron oxides, titanium oxides etc., coloring pigments such as iron blue, lapis, carbon black, etc. Dye can also be used. Coloring agents can be selected appropriately from those used for cosmetic purposes.

Preferably, inorganic pigments as above are essentially used from a safety viewpoint. However, as to these inorganic pigments, the primary particle size of, for example black iron oxide is about 0.2 μm to 1 μm whereas the primary particle size of applicable Indian red is 0.02 to 0.7 μm, and they have large specific weights. Accordingly, the specific weight of a cosmetic fluid containing these coloring agents amounts to about 1 to 1.4 when it is used as an eyeliner fluid though depending on the quantities of the coloring agents.

Reservoir element 112 is preferably not shorter than 30 mm and not longer than 50 mm.

If reservoir element 112 is equal to 50 mm or longer, there is a risk of the cosmetic dripping down from the application tip. It is also possible to regulate by increasing the amount of fibers in the reservoir, but the capillary force becomes too strong and the fluid flow passage becomes small. As a result, when pigments are used as the coloring agent for the cosmetic, for example when the aforementioned iron oxide or the like is used, the particle size is so large that there occurs the problem that the fluid cannot flow well.

On the other hand, if reservoir element 112 is equal to or shorter than 20 mm, there is a problem of the cosmetic content being low. It is particularly preferred that the reservoir is 30 mm or longer and 40 mm or shorter.

Disposition of tail plug 118A for air sealing at such a position that it is in contact with the rear end of reservoir element 112, makes it possible to make the surface area of the closed space of the fluid contact portion small while keeping gripping portion 114*b* long, whereby it is possible to reduce the amount of evaporation of the solvent and the like if the applicator has been left for a prolonged period of time. Further, since no dew condensation in the rear space due to temperature change arises and no escape of the solvent and others from reservoir element 112 that retains cosmetic occurs, it is possible to ensure the composition has little change.

The fluid cosmetic storage type applicator according to the third embodiment includes one-piece type tail plug 118 in which first tail plug 118C is formed continuously with second tail plug 118D as shown in FIG. 8. The components similar to those in the second embodiment are allotted with the same reference numerals.

One-piece type tail plug 118 is constructed such that first tail plug 118C and second tail plug 118D are joined by a rod portion 118E. Rod portion 118E has a cross-shaped section so as to reduce the weight. Further, in order to secure airtightness, annular ribs 118*f* are projectively formed on the outer peripheral surfaces of first tail plug 118C and second tail plug 118D so that they will abut the inner peripheral surface of cylindrical main barrel 114. Further, projectively formed on the outer peripheral surface at the rear end of second tail plug 118D is a flange 118*g* that abuts the rear end face of cylindrical main barrel 114 to position the one-piece type tail plug 118 and prevent second tail plug 118D hence first tail plug 118C from sinking further than needed.

First tail plug 118C has a substantially cup-like front-open configuration and its front end is formed with a plurality of front-open comb-like cutouts so that the teeth bite into reservoir element 112 to limit rotation of reservoir element 112 in circumferential directions.

Here, cap 116 is integrally formed of a cap body 116*a* and an inner sleeve 116*b* whose inner peripheral surface is formed so as to enclose the outer peripheral surfaces of applying part 110 and plastic mouthpiece 124, while the front end of cap body 116*a* is open and hence sealed by an ornamental plug 116*c*.

According to the fluid cosmetic storage type applicator of the third embodiment, since tail plug 118D for cylindrical main barrel 114 is provided in connection with (continuously to) tail plug 118C located at the position in contact with the rear end of reservoir element 112 for providing airtight sealing, it is possible to reduce the number of parts, and set first tail plug 118C and second tail plug 118D at the same time, realizing easy assembly. It goes without saying that no condensed water etc. will be generated in the space in the rear of first tail plug 118C inside cylindrical main barrel 114.

Now, the compared result between the embodiments of the present invention and the comparative examples will be described.

Figure 9:
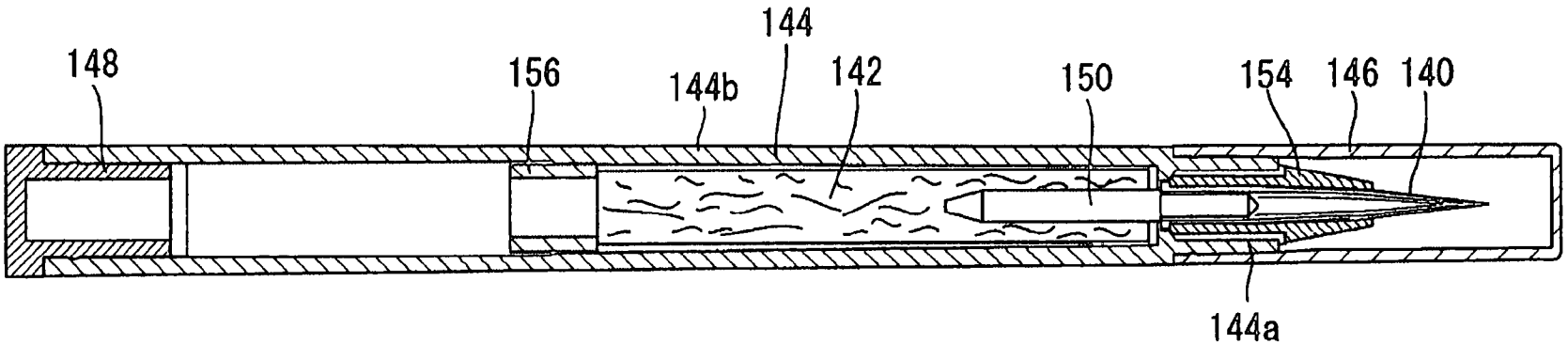
FIG. 9 is an illustrative view showing a vertical section of a comparative example 3 of a fluid cosmetic storage type applicator.
Figure 10:
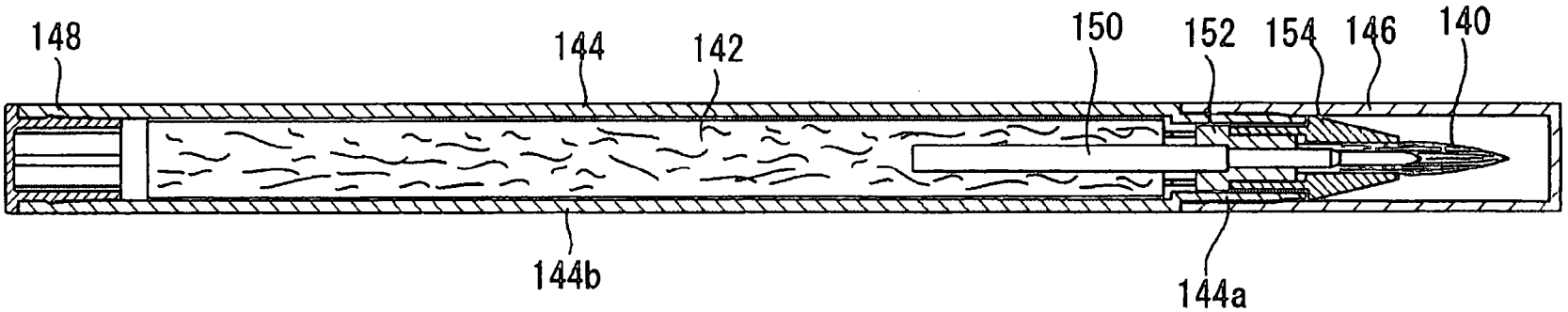
FIG. 10 is an illustrative view showing a vertical section of a comparative example 4 of a fluid cosmetic storage type applicator.
Figure 11:
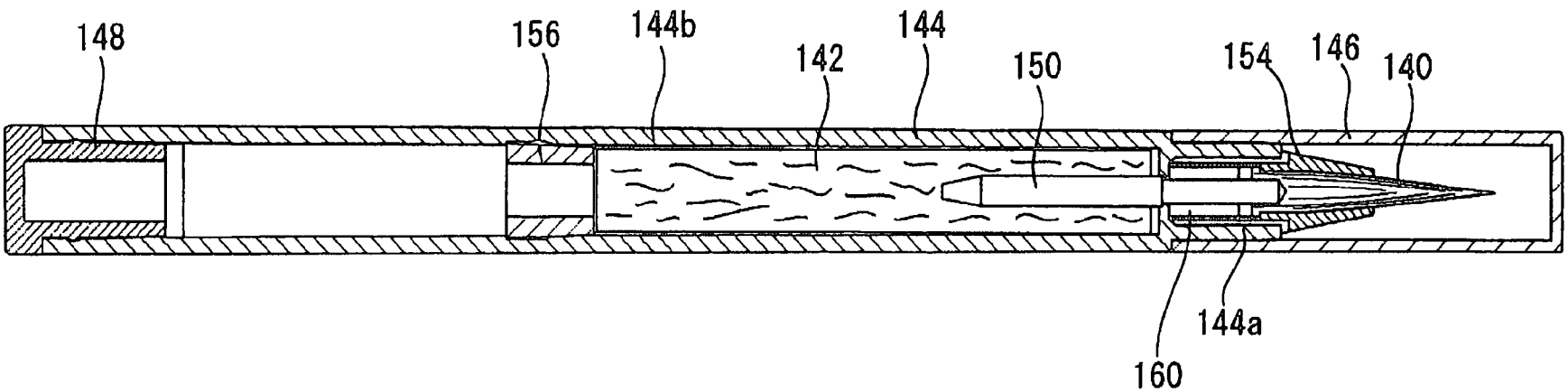
FIG. 11 is an illustrative view showing a vertical section of a comparative example 5 of a fluid cosmetic storage type applicator.

FIGS. 9, 10 and 11 are illustrative views showing the vertical sections of fluid cosmetic storage type applicators according to comparative examples 3, 4 and 5, respectively.

As shown in FIGS. 9, 10 and 11, the fluid cosmetic storage type applicators according to comparative examples 3, 4 and 5 each include; an applying part 140, a reservoir element 142 impregnated with cosmetic; a cylindrical main barrel 144 that holds reservoir element 142; and a cap 146 and tail plug 148 for keeping airtightness of cylindrical main barrel 144.

Further, a feeder core 150 that couples applying part 140 with reservoir element 142 for leading the cosmetic absorbed in reservoir element 142 to applying part 140 is provided inside front part 144*a* of cylindrical main barrel 144.

Here, front part 144*a* of cylindrical main barrel 144 is located in front of a gripping portion 144*b* in which reservoir element 142 is incorporated, and the outside diameter of the front part 144*a* is formed smaller than the outside diameter of the gripping portion 144*b*.

In front of front part 144*a* of cylindrical main barrel 144, a plastic mouthpiece 154 is arranged to cover applying part 140 halfway or further.

Cap 146 has an approximately cylindrical shape closed at its front end.

As shown in FIG. 9, in comparative example 3, applying part 140 is 20 mm or greater in length. Plastic mouthpiece 154 is constructed so as to cover the rear part of applying part 140 up to feeder core 150, keeping a clearance around them. A small space is given in the rear of applying part 140.

Further, in this comparative example 3, reservoir element 142 has about half the length of gripping portion 144*b* of cylindrical main barrel 144, and is held inside gripping portion 144*b*. A hollow cylindrical movement regulator 156 is disposed at a position partway along gripping portion 144*b* so as to limit the back and forth movement of reservoir element 142 while the rear opening of gripping portion 144*b* is closed with a tail plug 148.

As shown in FIG. 10, in comparative example 4, a cylindrical holding member 152 that covers feeder core 150 keeping a clearance around it is arranged inside front part 144*a* of cylindrical main barrel 144. In this comparative example 4, reservoir element 142 has almost the same length as that of gripping portion 144*b* of cylindrical main barrel 144 and is accommodated in the griping portion 144*b* while a tail plug 148 is provided to close the rear end.

As shown in FIG. 11, in comparative example 5, applying part 140 has the same length as that of the second embodiment and the third embodiment. Further, no holding member 152 that is provided in the above comparative example 4 exists, while plastic mouthpiece 154 is formed so that the part that is located inside front part 144*a* of cylindrical main barrel 144 is formed cylindrically with a large hollow therein, creating a space 160 around feeder core 150. That is, space 160 that is greater than that of comparative example 3 is formed in the rear of applying part 140. The other components are constructed in the same manner as in comparative example 3 so the same components are allotted with the same reference numerals.

[The First Test]

With regard to the fluid cosmetic storage type applicators having the configurations of the above second embodiment, third embodiment, comparative example 3, comparative example 4 and comparative example 5, reservoir element 112 or 142 was impregnated and filled up with a cosmetic eyeliner fluid composed of the following components, and the evaporation loss and fluid leakage were examined.

[Eyeliner Fluid]

black iron oxide: 9.5 parts,
Indian red: 5 parts,
acrylic alkyl copolymer: 3.5 parts,
1.3 butylene glycol: 10 parts,
phenoxyethanol: 0.5 part,
methyl para-hydroxybenzoate: 0.2 part
ethyl para-hydroxybenzoate: 0.1 part,
2-amino-2-methyl-1-propanol: 0.6 part,
di-sodium edetate: 0.1 part,
acrylic alkyl copolymer ammonium,
(emulsion solids 40%): 5 parts, and
purified water: 65.5 parts,
in total 100 parts.

The above eyeliner fluid in the amount of 0.6 ml (milliliter) was charged in the second embodiment, third embodiment, comparative example 3, comparative example 4 and comparative example 5 to prepare test samples.

[Sample Test Result]

(1) Evaporation Loss

The test results of the loss due to evaporation in the cosmetic storage type applicators of the present invention will be described.

Each sample of the second embodiment, third embodiment, comparative example 3, comparative example 4 and comparative example 5 had been left for one month under a 50 deg. centigrade atmosphere, and then was returned to a 20 deg. centigrade environment and the loss in weight of each sample was measured.

The second embodiment: the weight loss was 33.9 mg. The same application performance as in the initial state (before test) could be obtained. No condensed water was observed in the space in the rear of the cylindrical main barrel.

The third embodiment: the weight loss was 33.1 mg. The same application performance as in the initial state could be obtained. No condensed water was observed in the space in the rear of the cylindrical main barrel.

Comparative example 3: the weight loss was 56.7 mg. Condensed water was observed in the rear space.

Comparative example 4: the weight loss was 56.4 mg. No condensed water was observed in the rear space.

Comparative example 5: the weight loss was 55.9 mg. Condensed water was observed in the rear space. As to the drawn line color, because of the long brush the drawn line presented unevenness of some faintness of about 20 cm in length at its start but recovered the normal condition after that.

The amount of loss was smaller in the second embodiment and third embodiment compared to comparative example 3, comparative example 4 and comparative example 5. This can be presumed because the surface area at the contact liquid portion is smaller compared to comparative examples 3 to 5.

In the second embodiment, third embodiment and comparative example 4, the same writing performance as in the initial stage could be obtained. In comparative example 3 and comparative example 5, some blur occurred unless low application was done.

(2) Fluid Leakage

The test results as to the fluid leakage in the cosmetic storage type applicators according to the present invention will be described.

Each sample of the second embodiment, third embodiment, comparative example 3, comparative example 4 and comparative example 5 had been left with its application tip down for three days under a 50 deg. centigrade atmosphere, and then was observed as to fluid leakage.

The second embodiment: no change

The third embodiment: no change

Comparative example 3: no change

Comparative example 4: leakage of the eyeliner fluid found in the cap.

Comparative example 5: no change

[The Second Test]

Next, for the fluid cosmetic storage type applicators of the second embodiment, comparative example 3 and comparative example 5, test on change in state with passage of time and application test were done.

Here, a spacer (holding member 122) was provided for the second embodiment while no spacer was provided for comparative example 3 and comparative example 5.

[Eyeliner Fluid]

Sintered titanium and titanium oxides: 15 parts,
acrylic alkyl copolymer: 3.5 parts,
1.3 butylene glycol: 10 parts,
phenoxyethanol: 0.5 part,
methyl para-hydroxybenzoate: 0.2 part
ethyl para-hydroxybenzoate: 0.1 part,
2-amino-2-methyl-1-propanol: 0.6 part,
di-sodium edetate 0.1 part,
acrylic alkyl copolymer ammonium,
(emulsion solids 40%): 5 parts, and
purified water: 65 parts,
in total 100 parts.

Cylindrical main barrels 114 and 144 are charged with the above eyeliner fluid in the amount of 1 gram (g) by impregnating reservoir elements 112 and 142 of the first embodiment, comparative example 3 and comparative example 5 with the fluid to prepare test samples.

[Sample Test Result]

The samples of the aforementioned second embodiment, comparative example 3 and comparative example 5 had been left in a thermostat chamber with 12-hour cycles of 0 deg centigrade and 40 deg, centigrade for one month, then the condition around feeder core (bundled fiber core) 120 or 150 was observed. Thereafter, actual application was repeated.

The Second Embodiment

Condition: no change

Application test: presented as a good result as in the initial condition.

Comparative Example 3

Condition: adherence of condensed water inside the space around the feeder core was found, Application test: a drawn line similar to the initial state was obtained up to 50 cm in length from the beginning. Thereafter the drawn line presented unevenness of some faintness of about 20 cm in length, then recovered the normal condition after that.

Comparative Example 5

Condition: adherence of condensed water inside the space around the feeder core was found.

Application test: a drawn line similar to the initial state was obtained up to 50 cm in length from the beginning. Thereafter the drawn line presented unevenness of some faintness of about 20 cm in length, then recovered the normal condition after that.

[The Third Test]

For the fluid cosmetic storage type applicators of the second embodiment, third embodiment, comparative example 3, comparative example 4 and comparative example 5, test as to condensed water was done.

In this case, samples charged with the same eyeliner fluid as used in the above second test by impregnating reservoir element 112 or 142 were used for the test.

[Sample Test Result]

The samples of the aforementioned second embodiment, third embodiment, comparative example 3, comparative example 4 and comparative example 5 had been left in a thermostat chamber with 12-hour cycles of 0 deg. centigrade and 40 deg. centigrade for one week, then the interior part in the rear of the cylindrical main barrel was observed.

The Second Embodiment

Condition: no condensed water was observed in the space in the rear of the main barrel.

The Third Embodiment

Condition: no condensed water was observed in the space in the rear part of the main barrel.

Comparative Example 3

Condition: a large amount of condensed water was observed in the space in the rear of the main barrel.

Comparative Example 4

Condition: no condensed water was observed in the space in the rear part of the main barrel.

Comparative Example 5

Condition: a large amount of condensed water was observed in the space in the rear of the main barrel.

[Evaluation on Condensed Water]

The properties of condensed water were examined. The condensed water inside the main barrel was collected from the above resultant by removing the tail plug in comparative example 3 and comparative example 5. A bacterial challenge test was carried out by dripping the condensed water to an agar culture medium. Bacteria did not die in the medium after a lapse of one week after dripping, proving the presence of a liquid (condensed water) having no aseptic effect along the main barrel.

Here, the cosmetic storage type applicator of the present invention is not limited to the above embodiment modes. It goes without saying that various modifications can be made without departing from the scope of the invention. The cosmetic is not limited to eyeliner fluid. For example, the invention can be used with a lip fluid or the like.

INDUSTRIAL APPLICABILITY

The cosmetic storage type applicator of the present invention can be used for storing cosmetic such as eyeliner fluids, lip fluids and other various kinds of cosmetic fluids (slurry-like fluids and fluids containing micro solid particles) in the barrel cylinder with its applying part at the front end of the barrel cylinder removably covered by a cap and applying the cosmetic with the applying part for makeup.

The invention claimed is:

1. A cosmetic storage type applicator having a structure for supplying a cosmetic to an applying part from the interior of a barrel cylinder, including: a barrel cylinder for accommodating a cosmetic reservoir; an applying part disposed at the front part of the barrel cylinder for applying the cosmetic to a target object; and a holding member for covering the applying part over the periphery thereof from the barrel cylinder side, leaving the tip part of the applying part exposed, wherein a cap removably attached to the front part of the barrel cylinder for covering the applying part and holding member is provided; an inner sleeve having a tapered inside diameter toward the front end is arranged inside the cap body and is integrally formed with the cap body; wherein the cap is formed so that the outside base part of the inner sleeve is integrally jointed to the inside part of the cap body while a space is formed between the outer periphery of the inner sleeve other than the base part and the inner periphery of the cap body, a crown cap is fitted into an open front end of the cap body, and the inner peripheral surface from the inner sleeve to the cap body is formed free from steps, wherein a first tail plug for keeping airtightness inside the barrel cylinder is provided, the first tail plug being arranged in contact with the rear end of the reservoir, and a second tail plug is disposed behind the first tail plug and arranged with the rear end of the barrel cylinder, and wherein an inside diameter in a portion of the barrel cylinder from a vicinity of where the first tail plug creates airtightness inside the barrel cylinder toward the second tail plug is formed greater than an inside diameter in the portion of the barrel cylinder from the vicinity of the first tail plug creates airtightness inside the barrel toward the applying part.

2. The cosmetic storage type applicator according to claim 1, wherein the inner sleeve includes an inner peripheral surface formed correspondingly to the outer peripheral surface of the applying part and holding member; and a substantially static air layer is created between the inner peripheral surface of the inner sleeve and the outer peripheral surface of the applying part and holding member when the cap is fitted to the front part of the barrel cylinder, covering the applying part and holding member.

3. The cosmetic storage type applicator according to claim 2, wherein the air layer between the inner sleeve's inner peripheral surface and the outer peripheral surface of the applying part and holding member has a volume of 50 $mm^3$ to 150 $mm^3$.

4. The cosmetic storage type applicator according to claim 1, wherein a volume ratio S1/S2 is specified to be 0.1 to 0.4, where S1 is the volume of the air layer between the inner sleeve's inner peripheral surface and the outer peripheral surface of the applying part and holding member from a sealing structure that keeps airtightness between the cap and barrel cylinder's front part when the cap is fitted to barrel cylinder's front part to cover the applying part and holding member; and S2 is the volume of the interior space of the inner sleeve from the sealing structure when the cap is removed from barrel cylinder's front part.

5. The cosmetic storage type applicator according to claim 1, wherein the applying part has a sharpened tip end.

6. The cosmetic storage type applicator according to claim 1, wherein the applying part is formed of a brush-like form of bundled fibers.

7. A cosmetic storage type applicator, at least comprising: an applying part; a reservoir element impregnated with a cosmetic; a barrel cylinder for accommodating the reservoir element; and a cap and tail plug for keeping airtightness in the barrel cylinder, wherein the reservoir element impregnated with cosmetic having a full length between 30 mm and 50 mm is accommodated inside the barrel cylinder; and inside the barrel cylinder a first tail plug is disposed at a position in contact with the rear end of the reservoir element for sealing the barrel cylinder interior air tightly from the outside air and a second tail plug is disposed behind the first tail plug at the position of the rear end of the barrel cylinder so as to create airtightness inside the barrel cylinder, wherein an inside diameter in a portion of the barrel cylinder from a vicinity of where the first tail plug creates airtightness inside the barrel cylinder toward the second tail plug is formed greater than an inside diameter in the portion of the barrel cylinder from the vicinity of the first tail plug creates airtightness inside the barrel toward the applying part.

8. The cosmetic storage type applicator according to claim 7, wherein the first tail plug is formed continuously with the second tail plug.

9. The cosmetic storage type applicator according to claim 7, wherein a substantially cylindrical holding member for covering a feeder core that couples the applying part and the reservoir element for leading the cosmetic absorbed in the reservoir element to the applying part is arranged in substantially close contact around the feeder core in the front part of the barrel cylinder.

10. The cosmetic storage type applicator according claim 7, wherein the coloring agent of the stored cosmetic at least contains a pigment.

11. The cosmetic storage type applicator according to claim 7, wherein the applying part is a brush-like form made of plural hair-like pieces.

* * * * *